US005664361A

United States Patent [19]

Frommelt et al.

[11] Patent Number: 5,664,361

[45] Date of Patent: Sep. 9, 1997

[54] EXPLOSIVE POWDER CHARGE OPERATING SETTING TOOL

[75] Inventors: Markus Frommelt, Schaan, Liechtenstein; Norbert Heeb, Buchs, Switzerland

[73] Assignee: Hilti Aktiengesellschaft, Schaan, Liechtenstein

[21] Appl. No.: 704,339

[22] Filed: Aug. 27, 1996

[30] Foreign Application Priority Data

Sep. 1, 1995 [DE] Germany ..... 195 32 411.0

[51] Int. Cl.[6] ..... F41C 27/00

[52] U.S. Cl. ..... 42/106; 42/70.08; 42/69.02

[58] Field of Search ..... 42/106, 70.08, 42/69.02; 89/1.14, 1.4

[56] References Cited

U.S. PATENT DOCUMENTS

| | | | |
|---|---|---|---|
| 3,552,625 | 1/1971 | Udert | 227/10 |
| 4,138,788 | 2/1979 | Jochum | 42/1 R |
| 5,114,064 | 5/1992 | Jochum et al. | 227/9 |
| 5,170,922 | 12/1992 | Ehmig et al. | 227/8 |
| 5,220,123 | 6/1993 | Oehry | 89/1.14 |
| 5,329,839 | 7/1994 | Ehmig | 89/1.14 |
| 5,538,172 | 7/1996 | Jochum et al. | 227/10 |

*Primary Examiner*—Charles T. Jordan
*Assistant Examiner*—Meena Chelliah
*Attorney, Agent, or Firm*—Anderson Kill & Olick, P.C.

[57] ABSTRACT

An explosive powder charge operated setting tool includes a driving piston (1) positioned in an axially extending piston guide (4) with a base surface (5) at a trailing end of the piston guide. A spacer (2) is located on the trailing end surface of the piston (1) and projects axially from its trailing end surface. The spacer (2) has a stop face (3) extending perpendicularly of the piston guide axis with a surface area smaller than the area of the base surface (5) against which it contacts.

7 Claims, 2 Drawing Sheets

EXPLOSIVE POWDER CHARGE OPERATING SETTING TOOL

BACKGROUND OF THE INVENTION

The present invention is directed to an explosive powder charge operated setting tool containing a piston guide forming a piston guide bore for a driving piston. The trailing end of the piston guide has a passageway connected with a cartridge chamber. The passageway leading to the cartridge chamber is enclosed in a support. A housing part laterally encloses the piston guide and is spaced radially outwardly from it. A channel in flow communication with the cartridge chamber is provided between the piston guide and the housing part and the channel is connected to the guide bore through an aperture in the piston guide. A closable passage is located in the housing part and a closable valve arrangement is located in the channel so that a storage space is formed and located in the leading end regions of the channel and of the guide bore.

An explosive powder charge operated setting tool is disclosed in DE-OS 43 13 504 in which a driving piston is driven from a rear position into a front position by propelling gases developed when a propellant charge is ignited. Prior to ignition, the propellant charge is located in a cartridge chamber. The driving piston acts, before reaching its front or driving position, against fastening elements, such as bolts, nails and the like, which are driven into hard receiving materials such as concrete, metal and the like.

A base part located at the trailing end of the piston guide has an axial projection region, facing in the driving direction and formed of a support, an annular surface on the support, and an annular surface of a cartridge chamber guided in the support and located in the same plane. The support chamber is penetrated by a bore connecting the cartridge chamber to the guide bore. The diameter of the base part corresponds to the diameter of the guide bore.

To return the driving piston to its initial position after a driving operation has been completed, so that it is ready for the next driving operation, it must be moved from the front driving position into the rear initial driving position, ready for the next firing operation. The return of the driving piston is achieved, so that when the propellant charge is fired, the channel is still sealed off from the atmosphere. Directly after the driving piston has started to move forwardly through the guide bore, the channel is connected to the guide bore. Accordingly, the propellant gases, after they have acted on the driving piston, arrive in the channel enclosing the leading end of the guide bore. As soon as the leading end region of the channel and the guide bore are filled with the propelling gases, the valve arrangement is closed and a common storage space closed relative to the atmosphere is established. Within the storage space, the propelling gases are compressed by the piston driven forwardly into the front driving position. Next the gases within the channel and the guide bore move the driving piston backwardly, counter to the setting direction, into its rear initial position ready for the next firing operation.

Cartridges, developing a higher driving energy when they are ignited, are used when driving longer fastening elements. As a result, a greater quantity of the propelling gases arrive the storage spaces and are used for driving the driving piston back into its initial position. When fastening elements are driven into soft receiving materials, the driving piston encounters little resistance. Accordingly, the speed of the piston moving in the driving position is greater. Due to the higher speed of the driving piston, a larger quantity of propelling gases is compressed within the storage space. The energy in front of the compressed propellant gases, required for displacing the driving piston back to its initial position, is thus somewhat greater than when driving fastening elements into a hard receiving material.

When the pressure of the propelling gases acts against the driving piston, the piston is moved back into its initial position at such a high rate that it rebounds from the base surface of the piston guide and moves into a position spaced from the base surface. This position of the driving piston has a negative effect on the subsequent driving operations, since the propelling gases produced by the ignited cartridge impact against the piston in a location where the gases are already partially expanded. The driving piston is thus provided with a smaller acceleration in the setting direction. As a result, the fastening element is not driven into the receiving material for the desired depth.

SUMMARY OF THE INVENTION

Therefore, the primary object of the present invention is to provide an explosive powder charged operated setting tool in which the driving piston is located in its rearward initial position after each driving operation, independently of the condition of the receiving material, whether soft or hard.

In accordance with the present invention, a spacer is located in the axial projection region of the base surface of the piston guide, forming a stop face extending perpendicularly to the axis of the driving piston and having smaller area than the area of the base surface.

The spacer located between the base surface and the driving piston is elastically deformable and serves to dissipate excessive driving energy, so that a rebound of the driving piston from the base surface is prevented.

For economic and fabrication reasons, the spacer is located at the trailing end of the driving piston.

To achieve elastic deformation of the spacer, the area of the stop face of the spacer is smaller than the area of the base surface. Accordingly, the area of the stop face of the spacer is in the range of 0.04 to 0.5 times the area of the base surface.

The spacer surface is designed as a circular segment for fabrication and production reasons.

For achieving an adequate abutment of the driving piston at the base surface, preferably the spacer is located in the radially outer peripheral region of the trailing end of the piston.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE INVENTION

Figure 1:
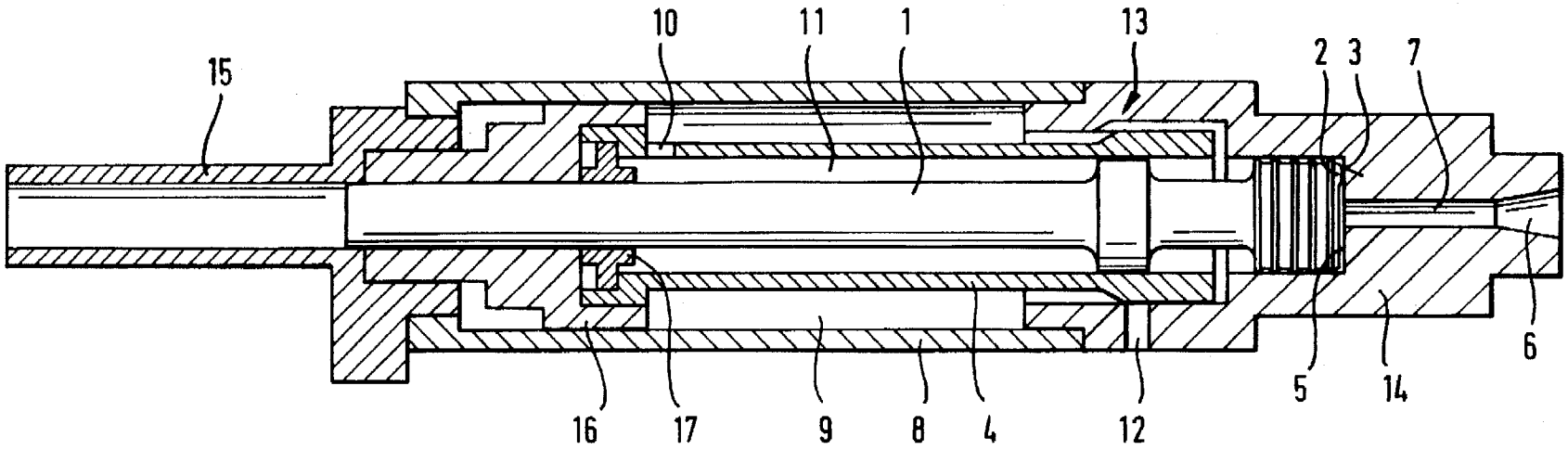
FIG. 1 is an axially extending side view, in section, of the essential parts of a explosive powder charge operating tool embodying the present invention, with the various parts shown in the rearward initial position, ready for a driving operation.
Figure 2:
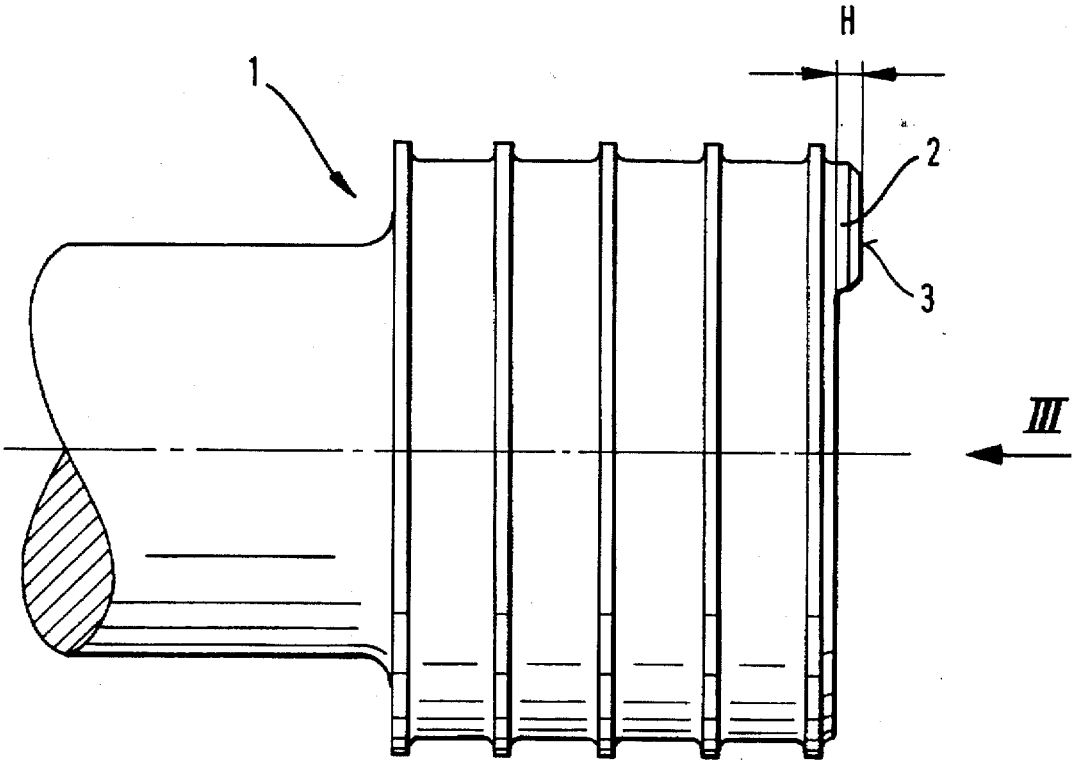
FIG. 2 is an enlarged side view of the trailing end region of the driving piston shown in FIG. 1.
Figure 3:
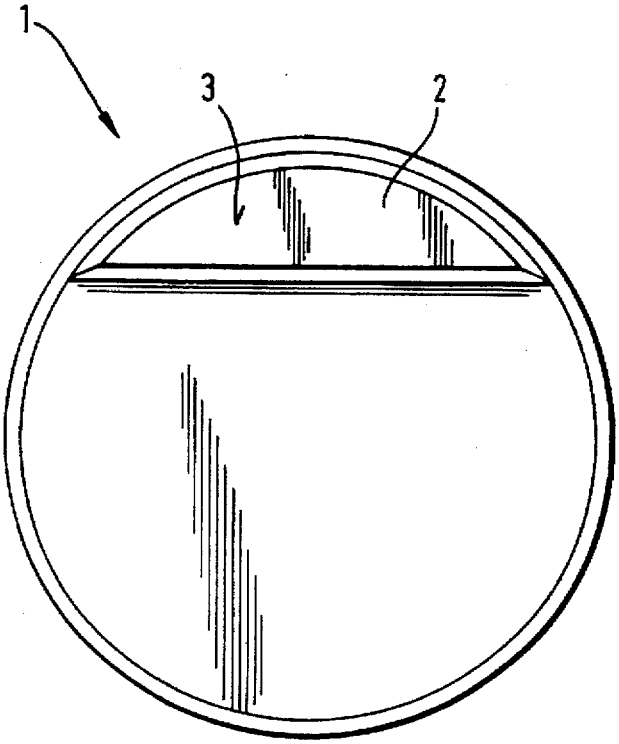
FIG. 3 is trailing end view of the driving piston shown in FIG. 1 and FIG. 2.

FIG. 1, 2 and 3 show the essential parts of an explosive powder charge operated setting tool embodying the present invention with the parts located in the rearward initial position, that is, in a position ready to fire or drive a fastening element. In FIG. 1 an axially extending driving piston 1 is located within an axially extending piston guide 4. The piston is supported within the piston guide 4. At the trailing end of the piston guide there is a support 14 with the trailing end of the driving piston positioned within a forward end region of the support. Located in the trailing end of the support is a cartridge chamber 6 with a bore 7 extending from the cartridge chamber into a bore 11 within the piston guide. A cartridge or propellant charge is not shown in the drawing. In a leading end region of the support 14 there is a passage 12 extending transversely of the axially direction of the piston guide.

The piston guide 4 is laterally enclosed by a housing part 8 spaced radially outwardly from the guide. The housing part 8 extends into contact with the leading end region of the support 14. An axially extending channel 9 is located between the housing part 8 and the piston guide 4 and this channel is flow communication with the cartridge chamber 6.

An opening 10 is located in the leading end region of the piston guide 4 for connecting the channel 9 to the guide bore 11 for the driving piston 1.

The leading end the piston guide has a multi-part guide arrangement. The guide arrangement is formed by an axially extending fastening element guide 15 followed opposite to the driving direction by a guide bush 16. The element guide 15 serves to receive and guide the fastening elements to be driven, not illustrated. The guide bush 16 serves to support both the driving piston 1 and the leading end region of the piston guide 4. Guide bore 11 has a damping element 17 at its leading end bearing against the trailing end surface of the guide bush, and the damping element affords a dampening of the impact of the driving piston as it moves forwardly into the driving position.

As mentioned, FIG. 1 shows the driving piston 1 in its initial position in the trailing end region of the guide bore 11 and in this position the setting tool is placed against the surface of a receiving material, not shown, into which a fastening element is to be driven.

As illustrated in FIG. 1, the channel 9 is closed off by the driving piston 1 from the bore 7 and the cartridge chamber 6. In this position, the valve arrangement 13 of the channel 9 is formed by a widened portion of the piston guide 4 and a constricted portion of the support 14 and the valve arrangement is in the open position. The opening 12 is closed by the piston guide 4, whereby the channel 9 is not connected to the atmosphere.

When a cartridge or propellant charge, not shown, is ignited or fired, the propellant gases generated flow through the bore 7 of the cartridge chamber 6 and drive the piston 1 forwardly into its front driving position. As the driving piston moves forwardly, the channel 9 is connected to the cartridge chamber 6 so that the propellant gases also flow through the channel 9 and the opening 10 into the guide bore 11. At this point, the passage 12 remains closed by the piston guide 4, so that there is no connection between the channel 9 and the atmosphere.

Due to the equal pressure of the propellant gases acting throughout the tool, the support 14 is displaced opposite to the driving direction relative to the piston guide, that is, acting against the action of the driving piston 1. Due to the mass relationships, a displacement of the support 14 occurs with some time delay, that is acting essentially only when the driving piston has reached its front driving position. In this position, the valve arrangement 13 is closed. Due to the relative displacement between the support 14 and the piston guide 4, the passage 12 is opened by the piston guide, whereby the channel is connected with the atmosphere.

The leading end regions of the channel 9 and of the guide bore 11 form a storage space closed to the atmosphere due to the closed valve arrangement 13. The storage space holds the propellant gases compressed by the action of the driving piston 1. These compressed propellant gases acting on the piston 1 displace it opposite to the driving direction into its rear initial position as shown in FIG. 1. Accordingly, the space between the piston guide and the support 14 is vented to the atmosphere through the opening 12. As a result, the tool parts are returned to the position shown in FIG. 1, whereby another driving operation can be effected by providing a new cartridge in the cartridge chamber 6.

The relative displacement of the support 14 along with the housing part 8 connected to it occurs relative to the piston guide 4 along with the guide arrangement connected to it and consisting essentially of the fastening element guide 15 and the guide bush 16.

The enlarged showing of the trailing end of the driving piston 1 in FIG. 2 shows a spacer 2 with a stop face 3 forming a single part with the driving piston. The spacer 2 has a height H extending from the trailing end of the piston 1 opposite to the driving direction. The height H is in the range of 0.05 to 0.2 times the diameter of the larger diameter trailing end of the driving piston 1. When the piston 1 is displaced rearwardly by the stored propellant gases, the spacer 2 prevents the driving piston 1 from rebounding away from the base surface 5 in the support 14, so that the piston remains in its initial position. The spacer 2 has an elastic deformation characteristic.

FIG. 3 shows the trailing end view of the driving piston 1. The spacer 2 is formed as a circular segment and is located at the radially outer region of the driving piston 1.

While specific embodiments of the invention have been shown and described in detail to illustrate the application of the inventive principles, it will be understood that the invention may be embodied otherwise without departing from such principles.

We claim:

1. Explosive powder charge operated setting tool having a setting direction for driving fastening elements into a receiving material and comprising means forming an axially extending piston guide (4) having a leading end and a trailing end spaced apart in the setting direction, said means forming an axially extending guide bore (11) for an axially extending driving piston (1) displaceable therein in the setting direction from a trailing initial position to a leading driven position, said means forming a cartridge chamber (6) at a trailing end, an axially extending bore (7) in said means connecting said cartridge chamber (6) and said guide bore (11), said means having a base surface (5) at a trailing end of said guide bore (11) forming a contact surface for a trailing end surface of said driving piston, said base surface (5) extending perpendicularly of said axially extending guide bore (11), an axially extending housing part (8) laterally enclosing and spaced radially outwardly from said piston guide and forming an axially extending channel (9) in flow communication with said cartridge chamber (7), said piston guide (4) having an aperture (10) in a leading end region thereof connecting said channel (9) with said guide bore (11), a closeable passageway (12) in said housing part (8), valve means (13) connected to said channel (9) and displaceable between an open position and a closed position for forming a storage space in the closed position, and a spacer element (2) for spacing the trailing end surface of said driving piston (1) from said base surface (5), said spacer element (2) having a stop face (3) extending perpendicularly to the axial direction of said piston guide (4) and having a smaller area than said base surface (5), and said stop face (3) spaced laterally outwardly from and asymmetrically relative to said driving piston axis.

2. An explosive powder charge operating setting tool, as set forth in claim 1, wherein said spacer being formed on and extending outwardly from the trailing end surface of said driving piston (1).

3. Explosive powder charge operated setting tool having a setting direction for driving fastening elements into a receiving material and comprising means forming an axially extending piston guide (4) having a leading end and a trailing end spaced apart in the setting direction, said means forming an axially extending guide bore (11) for an axially extending driving piston displaceable therein in the setting direction from a trailing initial position to a leading driven position, said means forming a cartridge chamber (6) at a trailing end, an axially extending bore (7) in said means connecting said cartridge chamber (6) and said guide bore (11), said means having a base surface (5) at a trailing end of said guide bore (11) forming a contact surface for a trailing end surface of said driving piston, an axially extending housing part (8) laterally enclosing and spaced radially outwardly from said piston guide and forming an axially extending channel (9) in flow communication with said cartridge chamber (7), said piston guide (4) having an aperture (10) in a leading end region thereof connecting said channel (9) which said guide bore (11), a closeable passageway (12) in said housing part (8), valve means (13) connected to said channel (9) and displaceable between an open position and a closed position for forming a storage space in the closed position, and a spacer element (2) for spacing the trailing end surface of said driving piston (1) from said base surface (5), said spacer element (2) having a stop face (3) extending perpendicularly to the axial direction of said piston guide (4) and having a smaller area than said base surface (5), said stop face (3) of said spacer (2) has an area in the range of 0.04 to 0.5 times the area of said base surface (5).

4. Explosive powder charge operated setting tool, as set forth in claim 3, wherein said driving piston has a larger diameter trailing end, said spacer (2) has a height (H) measured parallel to the axial extent of the said driving piston (1) in the range of 0.05 to 0.2 times the diameter of the larger diameter trailing end of said driving piston (1).

5. Explosive power charge operated setting tool, as set forth in claim 3, wherein said stop face (3) being formed as a circular segment.

6. Explosive powder charge operated setting tool, as set forth in claim 5, wherein said stop face being located in a radially outer region of the trailing end surface of said driving piston (1).

7. Explosive powder charge operated setting tool, as set forth in claim 3, wherein said spacer has an elastically deformable characteristic.

* * * * *